US010443837B2

(12) United States Patent
Strebe

(10) Patent No.: US 10,443,837 B2
(45) Date of Patent: Oct. 15, 2019

(54) DESUPERHEATER SYSTEM

(71) Applicant: Emerson Vulcan Holding LLC, St. Louis, MO (US)

(72) Inventor: Martin-Jan Strebe, Breda (NL)

(73) Assignee: Emerson Vulcan Holding LLC, St. Louis, MO (US)

( * ) Notice: Subject to any disclaimer, the term of this patent is extended or adjusted under 35 U.S.C. 154(b) by 78 days.

(21) Appl. No.: 15/088,511

(22) Filed: Apr. 1, 2016

(65) Prior Publication Data

US 2016/0290629 A1 Oct. 6, 2016

Related U.S. Application Data

(60) Provisional application No. 62/142,310, filed on Apr. 2, 2015.

(51) Int. Cl.
*F22G 5/12* (2006.01)

(52) U.S. Cl.
CPC ..... *F22G 5/123* (2013.01)

(58) Field of Classification Search
CPC . F22G 5/12; F22G 5/123; F22G 5/126; F22G 5/14; F22G 5/20
See application file for complete search history.

(56) References Cited

U.S. PATENT DOCUMENTS 2,155,986 A 4/1939 Wheaton
2,354,842 A 8/1944 Spence
2,421,761 A * 6/1947 Rowand ..... F22G 5/12 122/479.1
2,984,468 A 5/1961 Kuhner
3,219,323 A * 11/1965 Dexter ..... C21D 9/0037 122/459

(Continued)

FOREIGN PATENT DOCUMENTS

DE 4317241 A1 * 12/1994 ..... F22G 5/123
WO 9116969 A1 11/1991

(Continued)

OTHER PUBLICATIONS

International Search Report and Written Opinion for International Application No. PCT/US2016/025525; dated Jun. 20, 2016; 14 pages.

*Primary Examiner* — Steven S Anderson, II
(74) *Attorney, Agent, or Firm* — Quarles & Brady LLP

(57) ABSTRACT

Embodiments of the invention provide a desuperheater system for cooling a process fluid. The desuperheater system includes a pipe through which the process fluid flows and that defines an axis and includes injector housings attached to and arranged radially around the pipe. The injector housings each define an injector cavity. Injectors, each one including an injector nozzle that defines an injection angle, are received in each injector cavity so that the injector nozzles are in fluid communication with the process fluid. The injection angle of each injection nozzle is selected individually. The desuperheater system also includes a control valve with a valve inlet port configured to receive a cooling fluid. The control valve is configured to selectively provide fluid communication between the valve inlet port and at least one of the of injectors to inject the cooling fluid into the process fluid.

18 Claims, 7 Drawing Sheets

(56) References Cited

U.S. PATENT DOCUMENTS

| | | | | |
|---|---|---|---|---|
| 3,931,371 | A * | 1/1976 | Maurer | F22G 5/123 122/487 |
| 4,130,611 | A * | 12/1978 | Brand | B05B 1/1672 122/487 |
| 4,828,767 | A | 5/1989 | Smirnoff | |
| 4,880,447 | A | 11/1989 | Bloch | |
| 5,290,486 | A | 3/1994 | Enarson | |
| 5,336,451 | A | 8/1994 | Lovick | |
| 5,425,902 | A * | 6/1995 | Miller | B01J 19/32 261/128 |
| 5,692,684 | A * | 12/1997 | Zurmuhlen | B05B 1/1672 239/563 |
| 6,715,505 | B2 | 4/2004 | Higuchi | |
| 6,742,773 | B2 | 6/2004 | Higuchi | |
| 6,758,232 | B2 | 7/2004 | Higuchi | |
| 8,333,329 | B2 | 12/2012 | Ignatan et al. | |
| 2009/0065295 | A1 | 3/2009 | Sherikar et al. | |
| 2013/0074788 | A1 | 3/2013 | Ignatan et al. | |
| 2013/0118477 | A1 * | 5/2013 | Albrecht | F24J 2/4632 126/609 |
| 2014/0151908 | A1 * | 6/2014 | Forslund | F22G 5/12 261/160 |
| 2014/0252125 | A1 * | 9/2014 | Mastrovito | B05B 1/14 239/302 |
| 2014/0290755 | A1 | 10/2014 | Seewald et al. | |
| 2015/0128882 | A1 * | 5/2015 | Goodwin | F22G 5/123 122/487 |

FOREIGN PATENT DOCUMENTS

| | | | |
|---|---|---|---|
| WO | 9418499 | A1 | 8/1994 |
| WO | 9808025 | A1 | 2/1998 |
| WO | 2008104038 | A1 | 9/2008 |
| WO | 2009035924 | A1 | 3/2009 |
| WO | 2010148221 | A1 | 12/2010 |
| WO | 2014163810 | A1 | 10/2014 |

* cited by examiner

DESUPERHEATER SYSTEM

RELATED APPLICATIONS

This application claims priority under 35 U.S.C. § 119 to U.S. Provisional Patent Application No. 62/142,310 filed on Apr. 2, 2015, the entire contents of which are incorporated herein by reference.

BACKGROUND

Desuperheaters are used to cool a fluid, such as steam, from a superheated state to a state closer to the saturation temperature of the fluid. Typically, water is injected into a flow of a superheated fluid and evaporation of the water is used to cool the superheated fluid. Constant injection of water into the superheated fluid can cause high rates of thermal fatigue, which lead to insufficient cooling of the superheated fluid. Insufficient cooling of the superheated fluid can cause damage to components in many industrial applications due to elevated temperatures.

SUMMARY OF THE INVENTION

The above shortcomings are overcome by providing a desuperheater system that is configured to inject a cooling fluid using a ring-style arrangement of injectors with a flow control valve that controls fluid flow to each individual nozzle. Additionally, each injector includes a nozzle that can be arranged with variable injection angles.

A need exists for a desuperheater system with low maintenance that can resist thermal fatigue in high temperature and high cycling applications.

Some embodiments of the invention provide a desuperheater system for cooling a process fluid. The desuperheater system includes a pipe through which the process fluid flows and that defines an axis and injector housings attached to and arranged radially around the pipe. The injector housings each define an injector cavity. Injectors, each one including an injector nozzle that defines an injection angle, are received in each injector cavity so that the injector nozzles are in fluid communication with the process fluid. The injection angle of each injection nozzle is selected individually. The desuperheater system also includes a control valve with a valve inlet port configured to receive a cooling fluid. The control valve is configured to selectively provide fluid communication between the valve inlet port and at least one of the injectors to inject the cooling fluid into the process fluid.

Other embodiments of the invention provide a method of operating a desuperheater system for cooling a process fluid. The method includes selecting a first injector group with one of a first injection angle and a second injection angle, selecting a second injector group with one of the first injection angle and the second injection angle, passing a flow of steam through a pipe, moving a control valve piston mechanism to a first position where cooling fluid is inhibited from flowing to the first injector group and the second injector group, moving the control valve piston mechanism to a second position where cooling fluid is provided to the first injector group, atomizing the cooling fluid through swirl nozzles of the first injector group, moving the control valve piston mechanism to a third position where cooling fluid is provided to the first injector group and the second injector group, and atomizing cooling fluid through swirl nozzles of the second injector group that are arranged downstream of the first injector group.

DETAILED DESCRIPTION OF THE INVENTION

Figure 1:
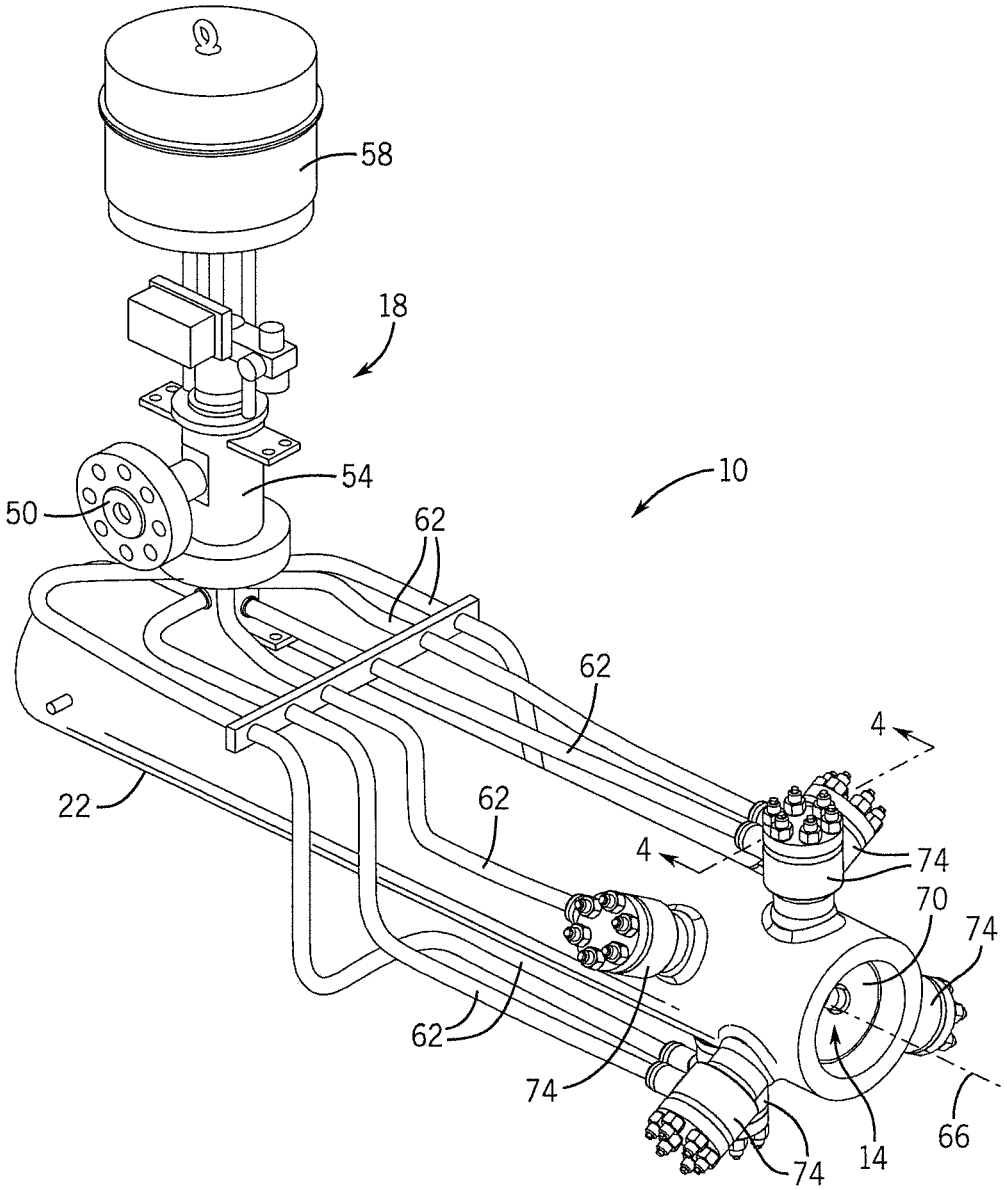
FIG. 1 is a perspective view of a desuperheater system according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

FIG. 1 shows a desuperheater system 10 according to one embodiment of the invention. The desuperheater system 10 includes six injectors 14 (one is visible in FIG. 1) for injecting a cooling fluid into a process fluid flow, and a control valve 18 coupled to a pipe 22 through which the process fluid flows. In one embodiment, the process fluid can be superheated steam and the cooling fluid can be liquid water. In other embodiments, the process fluid and the cooling fluid can be other suitable fluids. In other embodiments, more than six or less than six injectors 14 can be utilized.

The control valve 18 includes a valve inlet port 50 coupled to a piston housing 54, a piston mechanism 58 arranged within the piston housing 54, and injection tubes 62 each coupling the piston housing 54 to one of the injectors 14. The piston mechanism 58 is configured to selectively provide fluid communication between the valve inlet port 50 and the injectors 14 via the injection tubes 62.

The pipe 22 defines an axis 66 and includes a pipe liner 70 arranged concentrically within the pipe 22 and injector housings 74 attached to and arranged radially around the pipe 22 upstream from the control valve 18.

Figure 2:
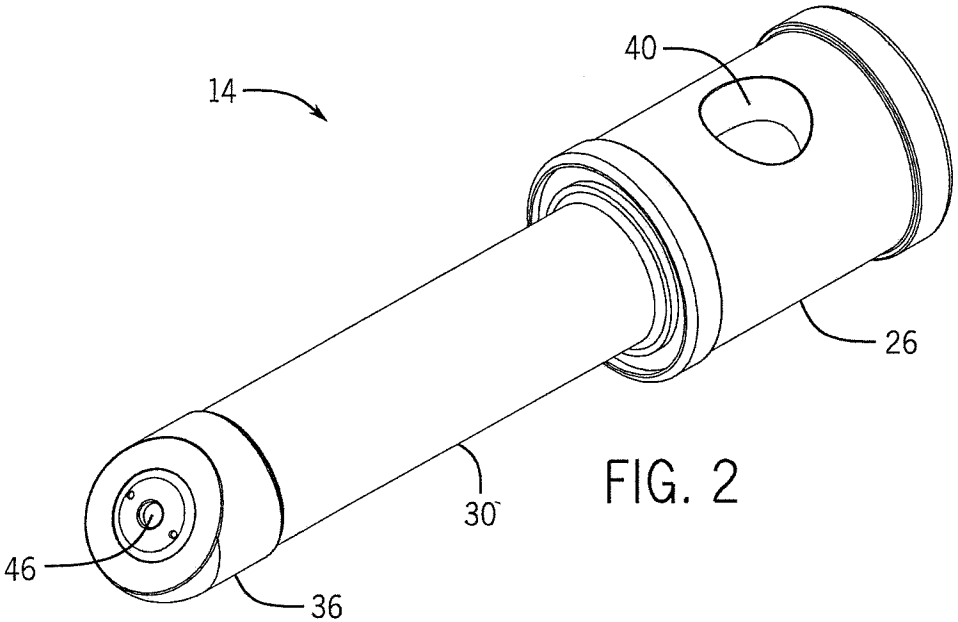
FIG. 2 is a perspective view of an injector of the desuperheater system of FIG. 1.

As shown in FIG. 2, the injectors 14 each include an inlet portion 26, a probe portion 30 extending from the inlet portion 26, and an injector head 36 attached to the probe portion 30 opposite from the inlet portion 26. The inlet portion 26 includes an injector inlet port 40. The injector head 36 includes an injector nozzle 46 arranged within the injector head 36 and in fluid communication with the injector inlet port 40.

Figure 3:
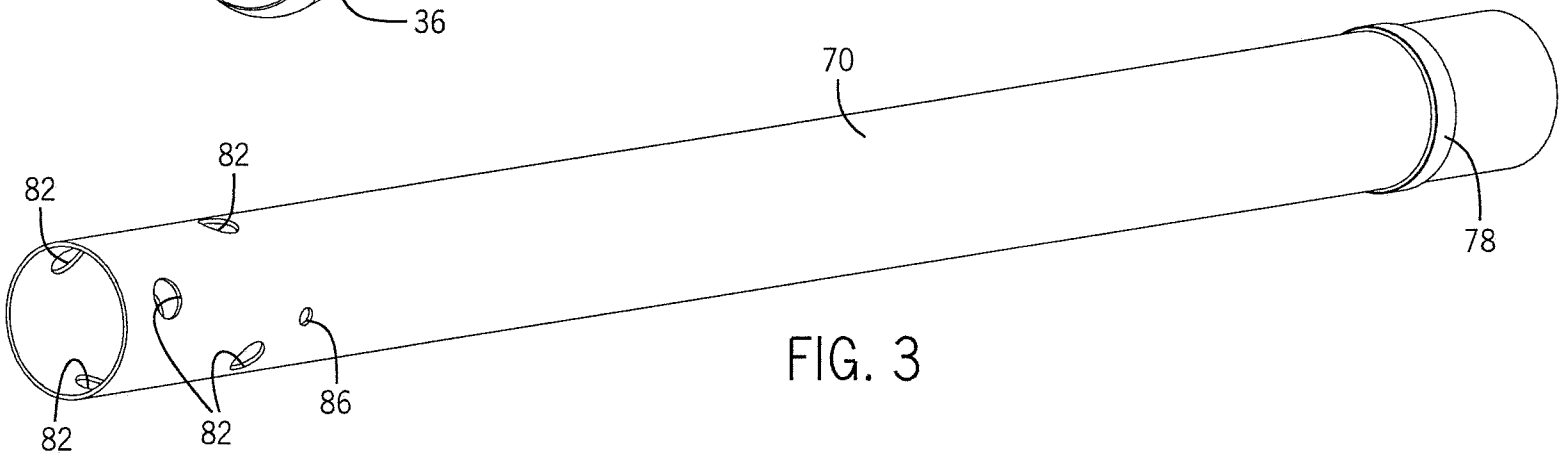
FIG. 3 is a perspective view of a pipe line of the desuperheater system of FIG. 1.

As shown in FIG. 3, the pipe liner 70 includes a spacer member 78 arranged to provide a radial gap between the pipe liner 70 and the pipe 22, a plurality of liner injector apertures 82 arranged radially around the pipe liner 70 upstream from the spacer member 78, and a pair of opposed liner ports 86 arranged adjacent to and downstream from the liner injector apertures 82. The radial gap provided by the spacer member 78 inhibits heat transfer between the process fluid and the pipe 22. The liner injector apertures 82 are each arranged to substantially align with a corresponding injector housing 74 on the pipe 22 so that when an injector 14 is installed within a injector housings 74, the injector head 36 of the injector 14 protrudes from the liner injector aperture 82.

Figure 4:
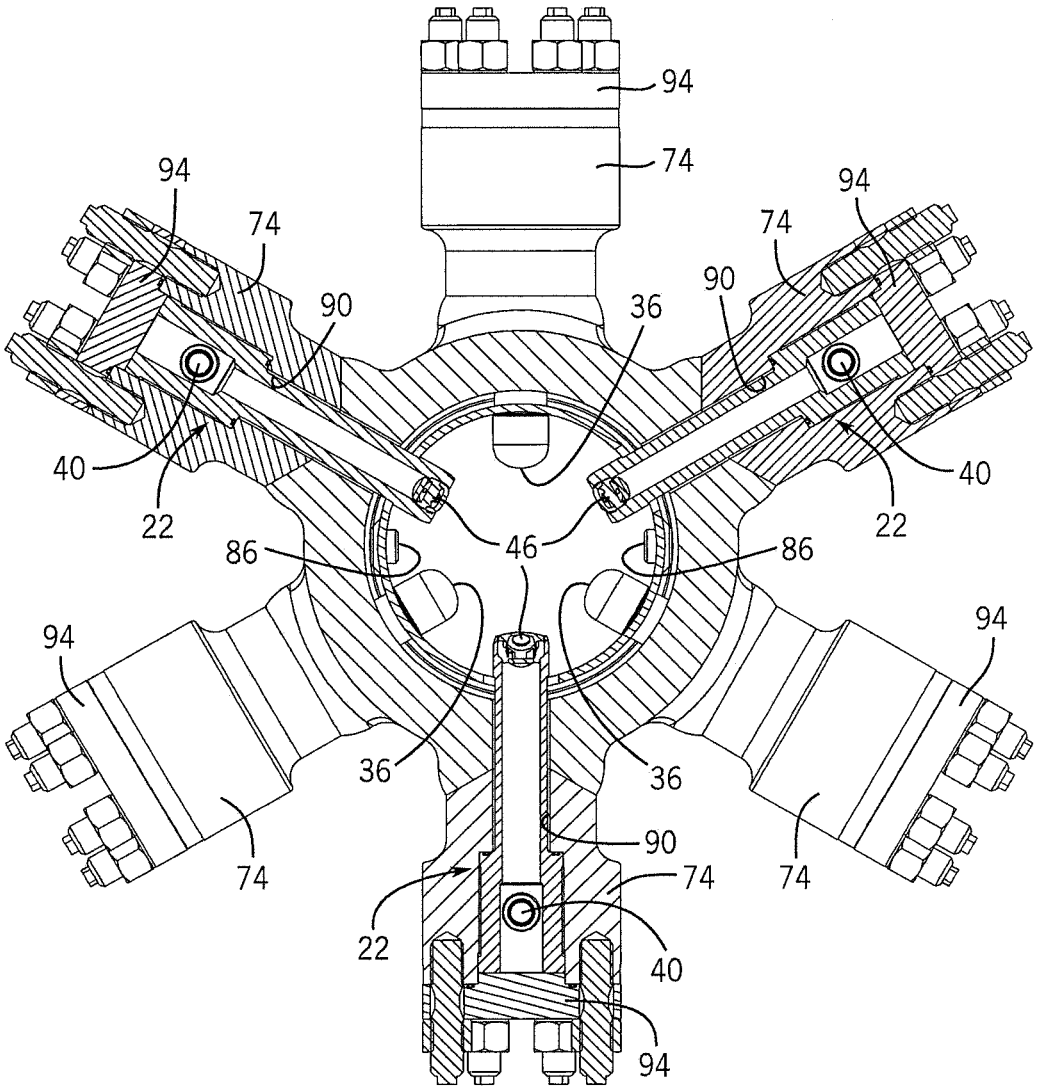
FIG. 4 is a sectional view of the desuperheater system taken along the line 4-4 of FIG. 1.

As shown in FIG. 4, the pipe 22 can include six injector housings 74 and the pipe liner 70 can include six corresponding liner injector apertures 82. The six injector housings 74 can be arranged in two groups radially around the pipe 22. A first group can include three injector housings 74 arranged radially in one hundred and twenty degree increments around the pipe 22 at a first axial location on the pipe 22. A second group can include the remaining three injector housings 74 arranged radially in one hundred and twenty degree increments around the pipe 22, offset sixty degrees from the first group, at a second axial location on the pipe 22 downstream from the first location. In this embodiment, the first and second groups can arrange the six injector housings 74 radially at sixty degree increments around the pipe 22. The six corresponding liner injector apertures 82 can be arranged to substantially align with the six injector housings 74. In other embodiments, the six injector housings 74 and the corresponding six liner injector apertures 82 can be arranged radially in any increments around the pipe 22 at any axial location on the pipe 22. In still other embodiments, the pipe 22 can include more than six injector housings 74 arranged radially in any increment around the pipe 22 at any axial location on the pipe 22, and the pipe liner 70 can include a corresponding number of liner injector apertures 82. In yet still other embodiments, the pipe 22 can include less than six injector housings 74 arranged radially in any increment around the pipe 22 at any axial location on the pipe 22, and the pipe liner 70 can include a corresponding number of liner injector apertures 82.

Figure 5:
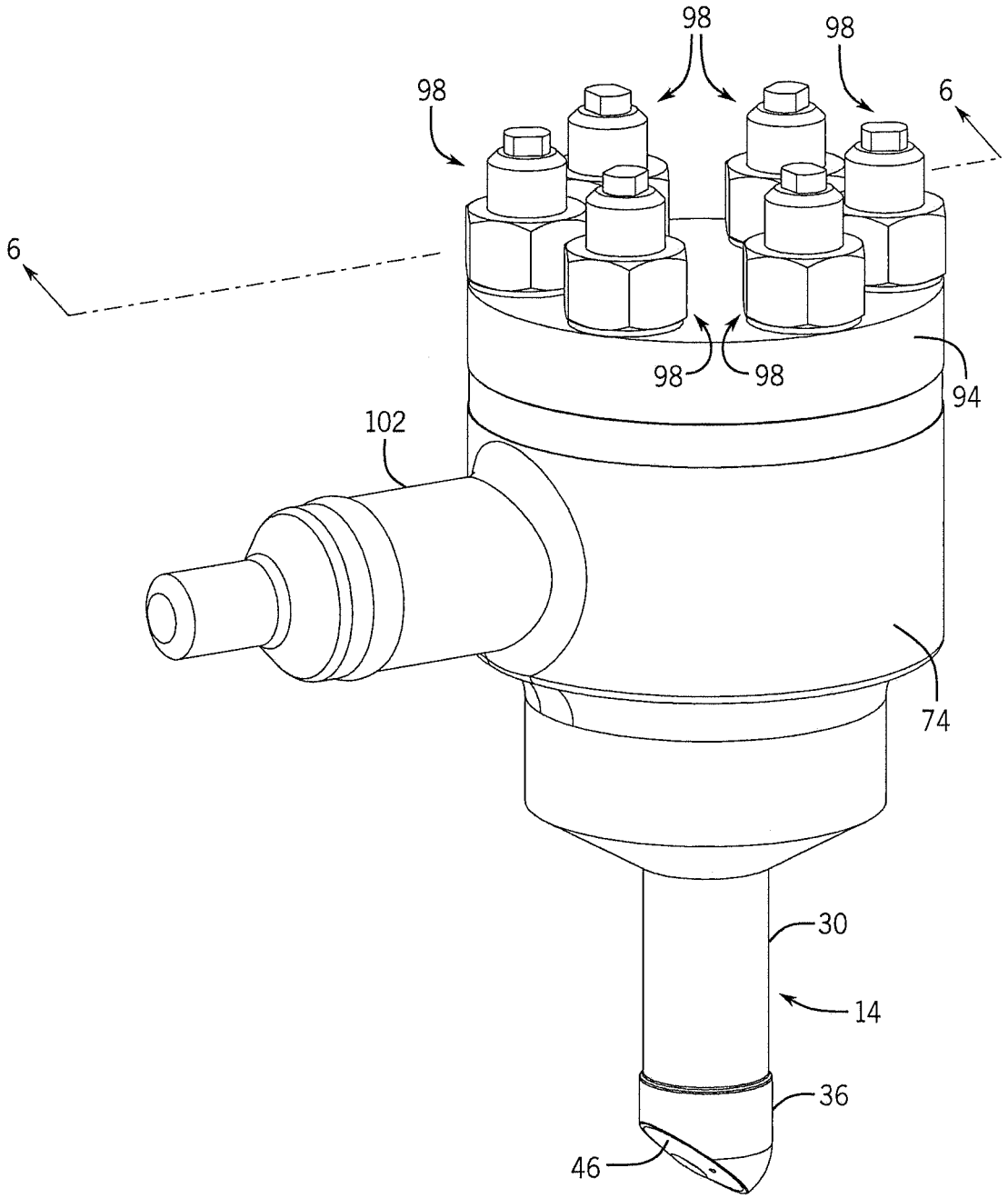
FIG. 5 is a perspective view of an injector housing of the desuperheater system of FIG. 1.
Figure 6:
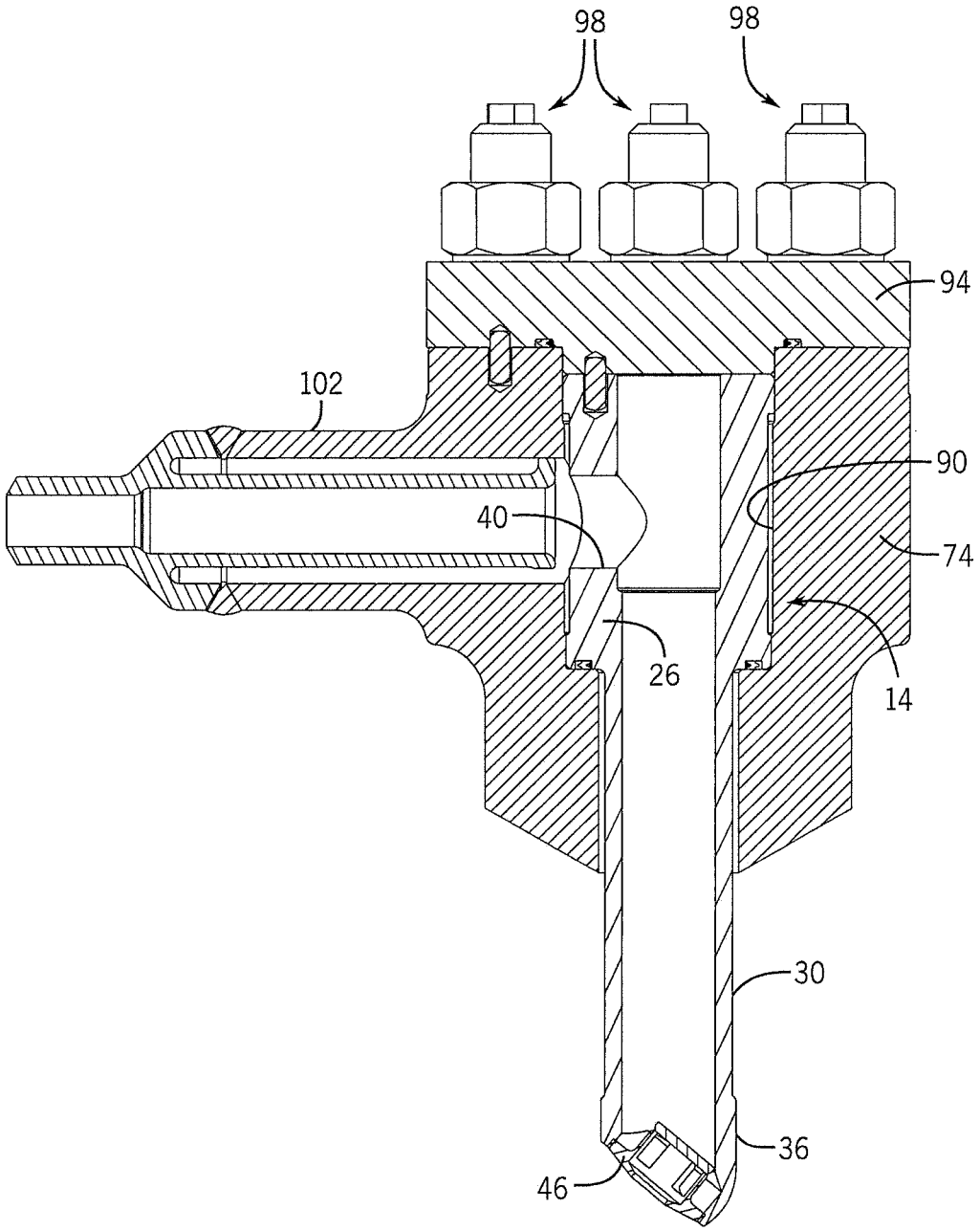
FIG. 6 is a sectional view of the injector housing taken along the line 6-6 of FIG. 5.

As shown in FIGS. 5 and 6, the injector housings 74 each define an injector cavity 90 configured to receive one of the injectors 14. The injector housings 74 include a plate 94 coupled to the injector housing 74 using fastener elements 98 and an injector housing inlet port 102. The injector cavity 90 is arranged within the injector housing 74 so that when one of the injectors 14 is installed within the injector housing 74, the injector head 36 protrudes from the injector cavity 90 through the liner injector aperture 82 and places the injector nozzle 46 in fluid communication with the process fluid flow in the pipe 22. The injector housing inlet port 102 is arranged so that when one of the plurality of injectors 14 is installed within the injector housing 74, the injector inlet port 40 is in fluid communication with the injector housing inlet port 102 to provide fluid communication between the piston housing 54 and the injector nozzle 46 via the injection tube 62.

Figure 7A:
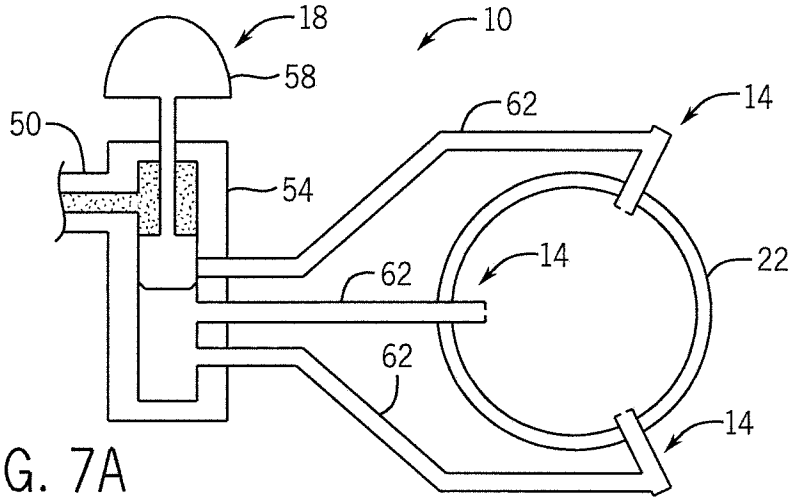
FIGS. 7A-7D are schematic views of the desuperheater system of FIG. 1.
Figure 7B:
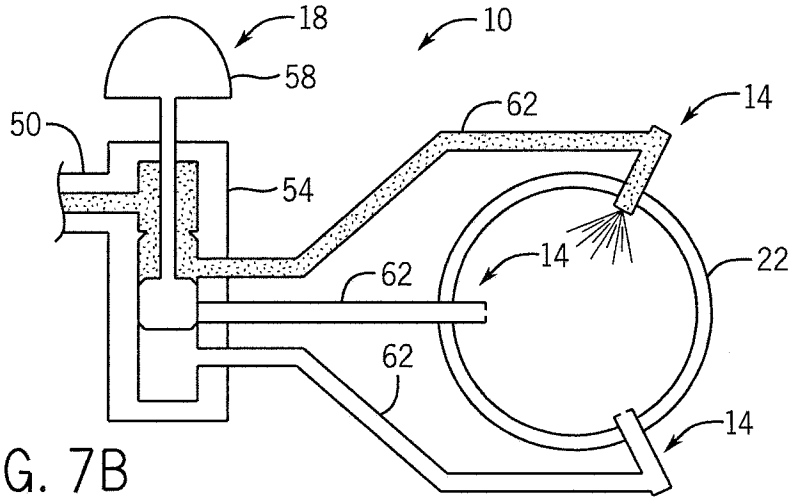
Figure 7C:
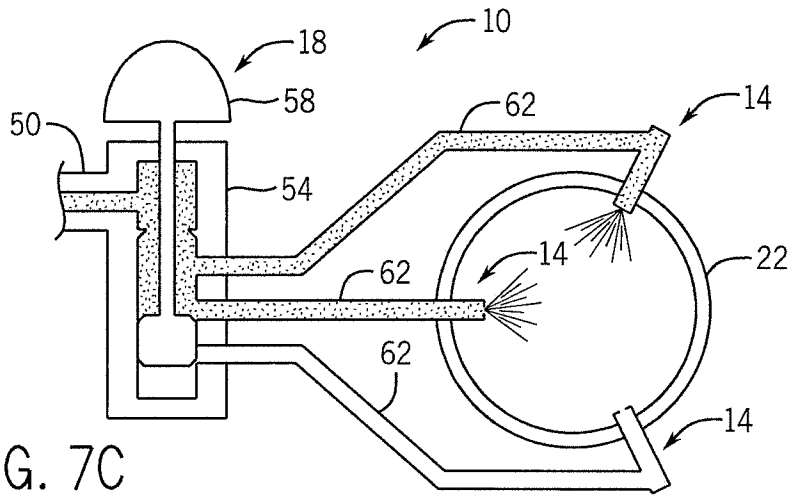
Figure 7D:
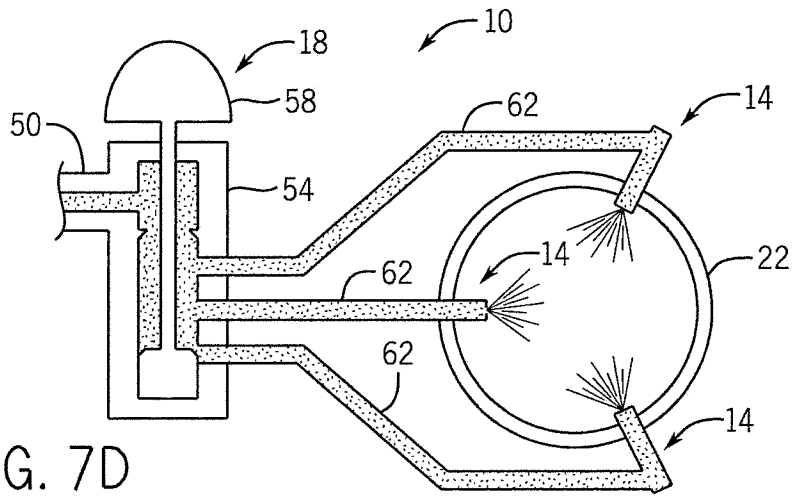

FIGS. 7A-7D illustrate operation of the desuperheater system 10. The process fluid flowing through the pipe 22 is typically in a superheated state and needs to be cooled before being further processed. A pressurized source of the cooling fluid is connected to the valve inlet port 50. The control valve 18 is configured to selectively provide fluid communication between the valve inlet port 50 and the injectors 14 via the injection tubes 62. As shown in FIG. 7A, if no cooling to the process flow is needed, the piston mechanism 58 inhibits fluid communication between the inlet port and the plurality of injectors 14. As shown in FIGS. 7B-7D, as the process fluid flow increases in temperature, the piston mechanism 58 moves to selectively provide fluid communication between the valve inlet port 50 and at least one of the injectors 14 to allow the cooling fluid to be injected into the process fluid through the injector nozzle 46. Injecting the cooling fluid into the process fluid through the injector nozzle 46 enables the cooling fluid to be atomized and provide quick evaporation of the cooling fluid into the process fluid to cool the process fluid. FIGS. 7A-7D show three groups, each with one injector 14. In other embodiments, two groups or more than three groups of injectors 14 may be utilized.

Figure 8A:
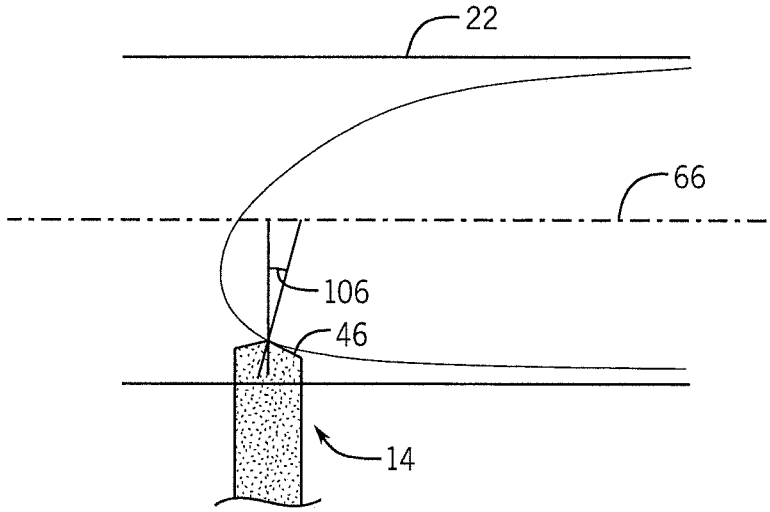
FIGS. 8A and 8B are schematic views of the injector of FIG. 2.
Figure 8B:
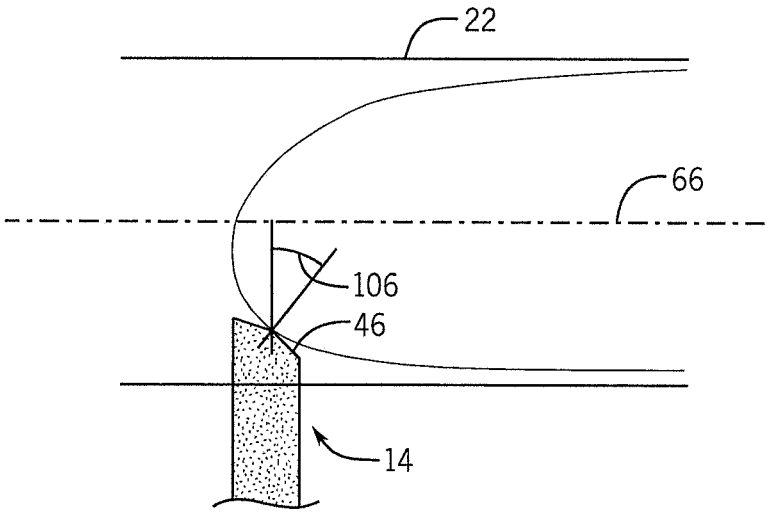

As shown in FIGS. 8A and 8B, an injection angle 106 is defined by a cone produced by injecting the cooling fluid through the injector nozzle 46. A narrow injection angle 106 can inject the cooling fluid more perpendicular to the axis 66, while a wider injection angle 106 can inject the cooling fluid further downstream in the direction of the process fluid flow. The design of the injector nozzle 46 determines the injection angle 106. In some embodiments, the injectors 14 can have different injector nozzles 46 or injector heads 36 to provide a different injection angle 106 for each of the injectors 14. For purposes of this application, the term injector nozzle can mean any part of an injector that alters the spray pattern, injection angle, or other spray characteristics of the injector, and can include the injector nozzle 46 and/or the injector head 36 as well as other parts. In other embodiments, at least one of the injectors 14 can have a first injector nozzle defining a first injection angle and the remaining injectors 14 can have a second injector nozzle defining a second injection angle, with the first injection angle being different than the second injection angle.

In some embodiments, the injector nozzle 46 can be a swirl nozzle. The injector nozzles 46 can be arranged with different injection angles dependent on application or installation specifications. In other words, the injection angle 106 of each injection nozzle 46 can be selected individually. The injection angle 106 is based on inertia of the water injected relative to the inertia of the steam flowing through the pipe liner 70. Additionally, the ability to include different injector nozzles 46 allows each injector 14 to be designed with an optimized coefficient of velocity (Cv). Smaller Cv injector nozzles 46 inject the cooling fluid more perpendicular to the axis 66 in order to achieve a desired penetration depth. Injector nozzles 46 with a relatively larger Cv inject relatively more parallel to the axis 66 to inhibit overspray and cooling fluid impingement on the wall of the pipe liner 70. Each injector nozzle 46 is selected individually and can be selected from at least a first nozzle and a second nozzle, where the first nozzle has a larger Cv than the second nozzle.

The control valve 18 can be designed to provide a minimum pressure drop from the valve inlet 50 to the injector inlet port 40. A maximum pressure drop can be achieved across the injector nozzle 46 providing enhanced atomization. The control valve 18 can also provide low noise and no cavitation. The selective control of the injectors 14 provided by the control valve 18 can enable the desuperheater system 10 to have a variable cooling capacity. The desuperheater system 10 can be applied in a variety of applications with varying process fluid flow temperatures.

The radial arrangement of the injectors 14 on the pipe 22 and the pipe liner 70 can prevent thermal fatigue of the desuperheater system 10. Additionally, the injector nozzles 46 can be configured to have different injection angles 106, which provide a maximum turndown ratio for the desuperheater system 10. In other words, the adjustability of the system 10 provides a larger operating range or applicable capacity for the desuperheater. Furthermore, the different injection angles 106 can prevent overspray and impingement of the cooling fluid within the pipe 22.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein.

Various features and advantages of the invention are set forth in the following claims.

What is claimed is:

1. A desuperheater system for cooling a process fluid comprising:

a pipe through which the process fluid flows defining an axis;

a plurality of injector housings attached to and arranged radially around the pipe, the plurality of injector housings each defining an injector cavity in fluid communication with an injector housing inlet port, the injector housing inlet port being in fluid communication with a cooling fluid;

a plurality of injectors each including an inlet portion at a first end and defining an injector inlet port and a probe portion extending from the inlet portion and including an injector nozzle defining an injection angle, the injector nozzle being at a second end opposite the first end, one of the plurality of injectors being received in each injector cavity with the injector inlet port aligned and in fluid communication with the injector housing inlet port, the injector nozzles being in fluid communication with the process fluid, the injection angle of each injection nozzle being selected individually;

a control valve including a valve inlet port configured to receive a cooling fluid, the control valve configured to selectively provide fluid communication between the valve inlet port and at least one of the plurality of injectors to inject the cooling fluid into the process fluid;

wherein the plurality of injector housings comprises six injector housings;

a first group of the six injector housings includes three injector housings arranged radially in one hundred and twenty degree increments around the pipe at a first axial location on the pipe; and a second group of the six injector housings includes three injector housings arranged radially in one hundred and twenty degree increments around the pipe, offset sixty degrees from the first group at a second axial location on the pipe.

2. The desuperheater system of claim 1, wherein the control valve further includes a piston housing, a piston mechanism arranged within the piston housing, and a plurality of injection tubes each providing fluid communication between the piston housing and one of the plurality of injectors.

3. The desuperheater system of claim 2, wherein the piston mechanism moves to selectively provide fluid communication between the valve inlet port and at least one of the plurality of injectors.

4. The desuperheater system of claim 1, wherein the first axial location is upstream of the second axial location.

5. The desuperheater system of claim 1, wherein the pipe further comprises a pipe liner arranged concentrically within the pipe and including a plurality of liner apertures.

6. The desuperheater system of claim 5, wherein the plurality of liner apertures are each arranged to substantially align with one of the plurality of injector housings.

7. The desuperheater system of claim 1, wherein each of the injector cavities receive the one of the plurality of injectors so that cooling flow from the control valve to the one of the plurality of injectors flows from the injector housing inlet port through the injector cavity before entering an injector inlet port of the one of the plurality of injectors.

8. The desuperheater system of claim 1, wherein the injector nozzles are swirl nozzles.

9. The desuperheater system of claim 1, wherein at least one of the injector nozzles is a first nozzle and at least one of the injector nozzles is a second nozzle, the first nozzle having a larger coefficient of velocity than the second nozzle.

10. The desuperheater system of claim 1, wherein the plurality of injectors are arranged radially around the pipe and spaced axially relative to one another.

11. The desuperheater system of claim 5, further including a spacer at an end of the liner, the spacer providing a radial gap between the liner and the pipe and inhibiting heat transfer between the fluid and the pipe.

12. A method of operating a desuperheater system for cooling a process fluid, the method comprising:

selecting a first injector group that includes a first plurality of injectors arranged circumferentially around a pipe at a first longitudinal location along the pipe and having one of a first injection angle and a second injection angle;

selecting a second injector group that includes a second plurality of injectors arranged circumferentially around the pipe at a second longitudinal location along the pipe that is different from the first longitudinal location, the second injector group being angularly offset from the first group by 60 degrees and having one of the first injection angle and the second injection angle;

passing a flow of steam through the pipe;

moving a control valve piston mechanism to a first position where cooling fluid is inhibited from flowing to the first injector group and the second injector group;

moving the control valve piston mechanism to a second position where cooling fluid is provided to the first injector group;

atomizing the cooling fluid through swirl nozzles of the first injector group;

moving the control valve piston mechanism to a third position where cooling fluid is provided to the first injector group and the second injector group; and atomizing cooling fluid through swirl nozzles of the second injector group that are arranged downstream of the first injector group.

13. The method of claim 12, wherein selecting a first injector group includes choosing from one of a first coefficient of velocity and a second coefficient of velocity.

14. The method of claim 12, wherein selecting the second injector group includes selecting an injection angle that is different than the injection angle selected for the first injector group.

15. The method of claim 12, further comprising moving the control valve piston mechanism linearly between the first position, the second position, and the third position.

16. The method of claim 12, wherein selecting the first injector group includes inserting the swirl nozzles of the first injector group into first injector housings coupled to the pipe.

17. The method of claim 12, wherein atomizing the cooling fluid through swirl nozzles of the first injector group includes atomizing the cooling fluid through three swirl nozzles arranged radially around the pipe.

18. A desuperheater system for cooling a process fluid comprising:

a pipe through which the process fluid flows, the pipe defining an axis;

a first group of three injector housings arranged radially in one hundred and twenty degree increments around the pipe;

a second group of three injector housings arranged radially in one hundred and twenty degree increments around the pipe, the second group of three injector housings being offset from the first set of three injector housings by sixty degrees and the second group of three injector housings being spaced along the axis from the first group of three injector housings, each of injector housings of the first and second groups of three injectors housings including an injector cavity;

a plurality of injectors each including an injector nozzle defining an injection angle, a respective one of the plurality of injectors being received in each injector cavity, the injector nozzles being in fluid communication with the process fluid, the injection angle of each injection nozzle being selected individually, each injection nozzle being selected from one of a first nozzle and a second nozzle, the first nozzle having a larger coefficient of velocity that the second nozzle; and a control valve including a valve inlet port configured to receive a cooling fluid, the control valve configured to selectively provide fluid communication between the valve inlet port and at least one of the plurality of injectors to inject the cooling fluid into the process fluid.

* * * * *